US005534084A

United States Patent [19]

Wakoh et al.

[11] Patent Number: 5,534,084

[45] Date of Patent: Jul. 9, 1996

[54] CONTINUOUS-CAST SLAB AND STEEL PRODUCT HAVING DISPERSED FINE PARTICLES

[75] Inventors: Masamitsu Wakoh; Takashi Sawai; Shozo Mizoguchi, all of Futtsu, Japan

[73] Assignee: Nippon Steel Corporation, Tokyo, Japan

[21] Appl. No.: 424,269

[22] PCT Filed: Apr. 25, 1993

[86] PCT No.: PCT/JP93/01194

§ 371 Date: Apr. 24, 1995

§ 102(e) Date: Apr. 24, 1995

[87] PCT Pub. No.: WO95/05909

PCT Pub. Date: Mar. 2, 1995

[30] Foreign Application Priority Data

Feb. 26, 1992 [JP] Japan ..... 4-39796

[51] Int. Cl.[6] ..... C22C 38/04; C22C 38/02

[52] U.S. Cl. ..... 148/328; 148/331; 148/320

[58] Field of Search ..... 148/320, 328, 148/331

[56] References Cited

FOREIGN PATENT DOCUMENTS

| | | |
|---|---|---|
| 61-79745 | 4/1986 | Japan . |
| 61-238940 | 10/1986 | Japan . |
| 1-228643 | 9/1989 | Japan . |
| 3-47664 | 2/1991 | Japan . |

*Primary Examiner*—Deborah Yee
*Attorney, Agent, or Firm*—Kenyon & Kenyon

[57] ABSTRACT

A cast slab comprising fine particles of oxides and MnS, said oxide comprising an Mn silicate, with Mn oxide occupying 50 to 80% by weight of the sum of Mn oxide and Si oxide, unavoidably included oxides, and an optionally added oxide of at least one member selected from Zr, Ti, Ce, Hf, Y, and Al, said oxide having a size of 0.1 to 10 μm being dispersed in an amount of 30 to 2000 pieces per $mm^2$ of section of said cast slab. The dispersion of many oxide particles, which are likely to serve as nucli for the precipitation of MnS, in said cast slab can provide a plate steel having good toughness in a HAZ and a steel sheet product having excellent deep drawability.

5 Claims, 3 Drawing Sheets

CONTINUOUS-CAST SLAB AND STEEL PRODUCT HAVING DISPERSED FINE PARTICLES

TECHNICAL FIELD

The present invention relates to a low-sulfur continuous-cast slab and a steel product comprising a steel with many oxides, which are likely to serve as nucli for the precipitation of MnS, and MnS being finely dispersed therein.

BACKGROUND ART

Steel products for large structures, by virtue of advance in steelmaking techniques in recent years, have been improved in various respects, offering excellent matrix properties. In general, however, it is difficult to maintain, for example, the properties of weld heat affected zones, which appear in joints formed by welding, on a level comparable to the matrix properties provided in the course of production of a steel product. This is because welding heat coarsens the particles in a heat affected zone (hereinafter referred to as "HAZ"), rendering the steel brittle. That is, it is known that the size of grains in a HAZ greatly influences low-temperature toughness of the steel. This led to the development of a technique for the refinement of HAZ structures which is now in practical use.

For example, Japanese Unexamined Patent Publication (Kokai) No. 61-79745 proposes a technique where Ti is added to steel to disperse therein an austenite grain fine Ti oxides which are utilized as transformation nucli to develop transgranular ferrite, thereby refining the HAZ structure. Japanese Unexamined Patent Publication (Kokai) No. 61-238940 discloses that uniform dispersion of fine Ti oxides as secondary deoxidation products results in improved toughness in a HAZ.

Japanese Unexamined Patent Publication (Kokai) No. 01-228643 discloses that the addition of deoxidizers, such as Zr, Ti, Ce, Y, and Hf, to molten steel having regulated dissolved oxygen content followed by fine dispersion of MnS utilizing the resultant deoxidation products as nucli refine the steel structure, contributing to improvement in toughness in a HAZ and other steel properties. Japanese Unexamined Patent Publication (Kokai) No. 03-047664 teaches that MnO—$SiO_2$ (Mn silicate) oxides are suitable as nucli for the precipitation of MnS.

Also in the case of steel sheets for cold working, it is known that fine dispersion and precipitation of MnS accelerate the precipitation of cementite in the step of continuous annealing, improving the workability.

AS described above, it is known that deoxidation products produced in steel and MnS can be utilized to improve the quality of the steel and that Mn silicate oxides are suitable as nucli for the precipitation of MnS. One means for improving the quality of the steel is to finely disperse many MnS precipitates. In order to precipitate a large amount of MnS, it is common practice to increase the content of S. Since, however, S in many cases adversely affects various properties of the steel, the S content is preferably minimized, to up to 0.01%.

For this reason, finding of optimal conditions of oxides for the precipitation of Fins becomes necessary for increasing the number of precipitated MnS while maintaining a low S content.

An object of the present invention is to provide steel slabs and steel products with a large amount of MnS being finely precipitated therein while maintaining low S content.

Another object of the present invention is to provide cast slabs containing oxides which permit such Fins to precipitate.

A further object of the present invention is to provide steel products having excellent properties in weld heat-affected zones.

DISCLOSURE OF INVENTION

In order to solve the above problems, the present inventors have made studies from two viewpoints, i.e., with a view to improving the ability of oxides as nucli for the precipitation of MnS and maximizing the number of oxides. For the former purpose, studies have been made on the optimal constituent ratio of MnO to $SiO_2$ with respect to Mn silicate, i.e., oxides which are likely to precipitate MnS, while for the latter purpose, studies have been made on the cooling rate of slabs and the addition of other strong deoxidizing elements to form complex oxides in order to increase the number of Mn silicates having the optimal constituent ratio. Various experiments have been carried out for these studies, which has led to the completion of the present invention.

According to the present invention, in slabs comprising by weight Mn: 0.1 to 3.0%, Si: 0.003 to 1.5%, and S: 0.001 to 0.01% and suitable amounts of other elements optionally added according to desired properties, for example, Cu, Ni, Cr, Mo, Nb, V, B, and Ca, the oxide present in the slab is constituted by Mn oxide (MnO), Si oxide ($SiO_2$), and unavoidably included oxides, for example, oxides of Ca, Mg, Al, and Zr, and, further, the proportion of the Mn oxide is specified to 50 to 80% of the sum of the Mn oxide and the Si oxide, thereby improving the percentage precipitation of MnS precipitated from these oxides (the number of oxides which have served to precipitate MnS/the total number of oxides observed in the measuring field of view) to 40 to In this case, the oxygen content of molten steel before the addition of Mn and Si to the molten steel should be brought to not less than 70 ppm from the viewpoint of attaining the optimal constituent ratio of MnO to $SiO_2$.

Thus, in order to refine and maximize the number of oxides improved in the ability to precipitate MnS by regulating the constituents added to the molten steel, a slab (thickness: 0.1 to 30 mm) is produced by a thin material continuous-cast process involving the step of cooling at a rate of not less than 20° C./min in the whole region of the slab, or alternatively a slab (thickness: 30 to 400 mm) is produced by a conventional continuous cast process wherein 0.002 to 0.05% by weight in total of at least one element selected from Zr, Ce, Hf, Ti, Y, and Al is further added as a strong deoxidizing element to the above molten steel and the rate of cooling in the whole slab region is not less than 5° C./min. The above casting enables an oxide having a diameter of 0.1 to 10 μm to be precipitated and dispersed by 30 to 2000 pieces per $mm^2$ of area of the slab in the course of solidifying the slab.

MnS is precipitated from the above fine oxides having a high ability to precipitate MnS in the course of cooling of a slab. Finally, MnS and the oxide having the above diameter are precipitated and dispersed by the number in the above range in the solidified slab.

A steel product produced from the above slab has fine ferrite structure and cementite structure, resulting in a significantly improved r value of the steel product or properties in a weld heat-affected zone (toughness in a HAZ).

BEST MODE FOR CARRYING OUT THE INVENTION

The present invention will now be described in detail.

The present inventors first carried out an experiment on the production of Mn silicates, i.e., oxides which are likely to serve as nucli for the precipitation of MnS, under various conditions. Specifically, in order to examine the constituent ratio of MnO to $SiO_2$ in Mn silicate oxides produced in molten steel and the number of MnS precipitated from oxides, an experiment was carried out, both on laboratory scale and on the scale of an actual production process including the conventional continuous-cast process, using molten steels having compositions, as specified in Table 1, with varied proportions of Mn and Si added. In this case, the constituent ratio of MnO to $SiO_2$ was determined under a scanning electron microscope, and the number of precipitated MnS was measured with a two-dimensional X-ray microanalyzer.

TABLE 1

(wt %)

| Sample | C | Mn | Si | P | S | Al | Remarks |
|---|---|---|---|---|---|---|---|
| A | 0.1 | 1.0 | Varied from 0.002 to 2.1 | 0 | 0.005 | 0 | Experiment in lab |
| B | 0.1 | 1.0 | Varied from 0.01 to 1.0 | 0.005 | 0.005 | 0.006 | Actual production process test |

Figure 1:
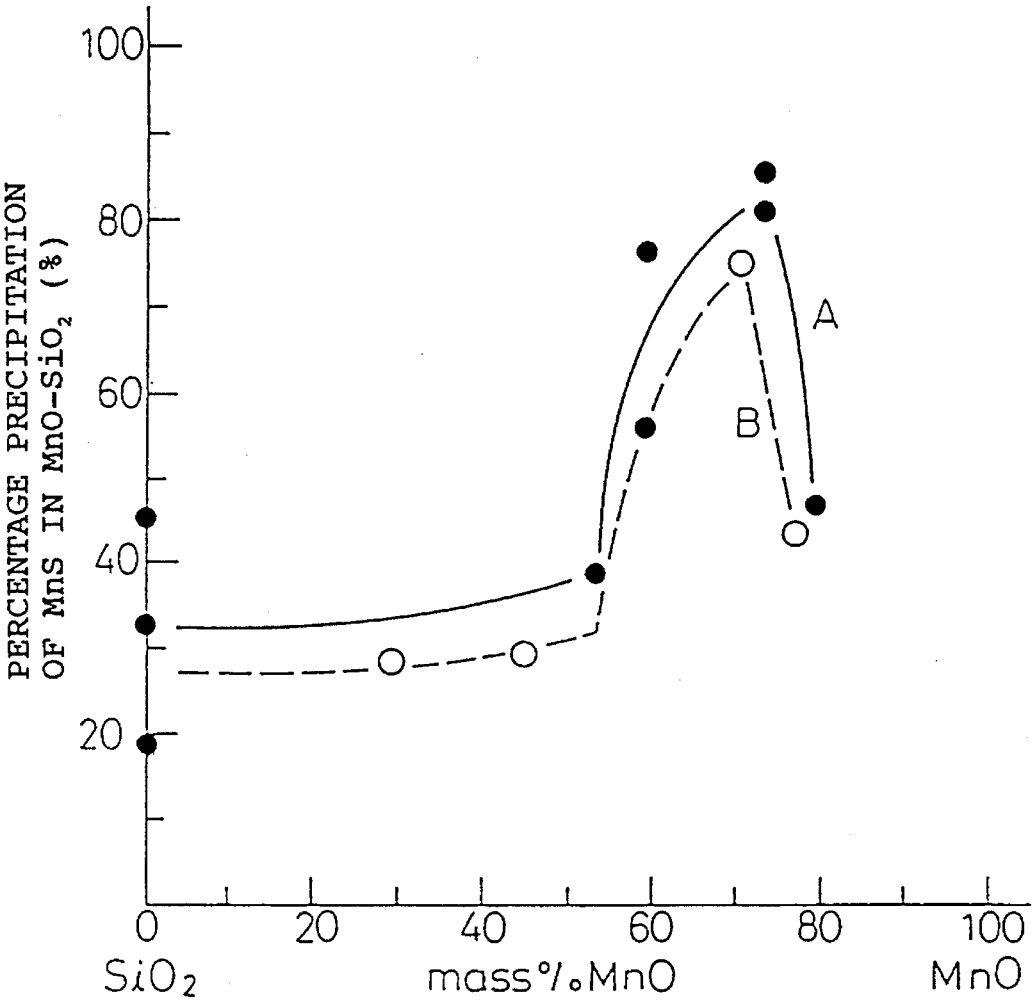
FIG. 1 is a diagram showing the relationship between the proportion of MnO to the sum of MnO and $SiO_2$ and the percentage precipitation of Fins in MnO-$SiO_2$ obtained in a laboratory and an actual production process.

The results are shown in FIG. 1. In the drawing, sample A shows the results of the experiment conducted in a laboratory, while sample B shows the results of the experiment conducted in an actual production process. From this drawing, it is apparent that when the proportion by weight of Mn oxide (MnO) falls within the range of 50 to 80% of the sum of MnO and Si oxide ($SiO_2$), the percentage precipitation of MnS precipitated utilizing oxides as a nucli (the number of oxides from which MnS has been precipitated/the total number of oxides) becomes very high for both sample, A and B.

Therefore, the regulation of the constituent ratio of MnO to $SiO_2$ in the above range enables a large number of MnS to be precipitated even when the level of the S content is as low as 50 ppm.

The laboratory experiment was carried out under the following conditions.

Ingot size: 50 mm in diameter×70 mm in height

Melting furnace used: 1 kg high frequency melting furnace

Sampling position: center portion of the ingot

The production process experiment in the actual production process was carried out under the following conditions.

Size of slab: 170 mm in thickness×700 mm in height

Figure 2:
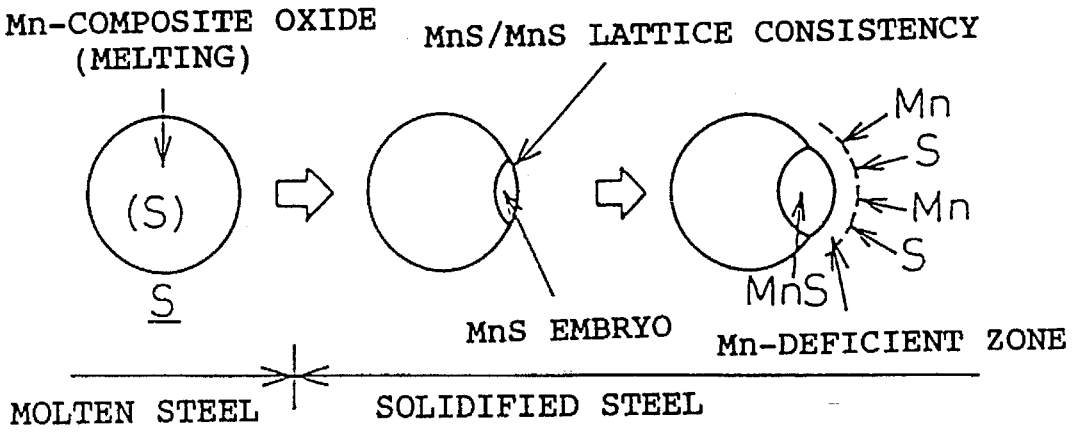
FIG. 2 is an explanatory view for the mechanism of precipitation of MnS utilizing an oxide as a nucleus.

Casting equipment used: continuous casting equipment with a casting rate of 1.0 m/min Sampling position: center portion of slab The above results can be explained by the mechanism, shown in FIG. 2, of precipitation of MnS utilizing an oxide as a nucleus. Specifically, as shown in FIG. 2, S dissolved in an oxide containing Fin oxide, such as Mn silicate, forms MnS on the surface of the oxide with the decrease in temperature after solidification of steel. This triggers the precipitation of MnS from subsequently solidified steel on the oxide. For this purpose, the oxide should previously dissolve S in the molten steel and, therefore, should have a low melting point and a high capability of dissolving S.

Figure 3:
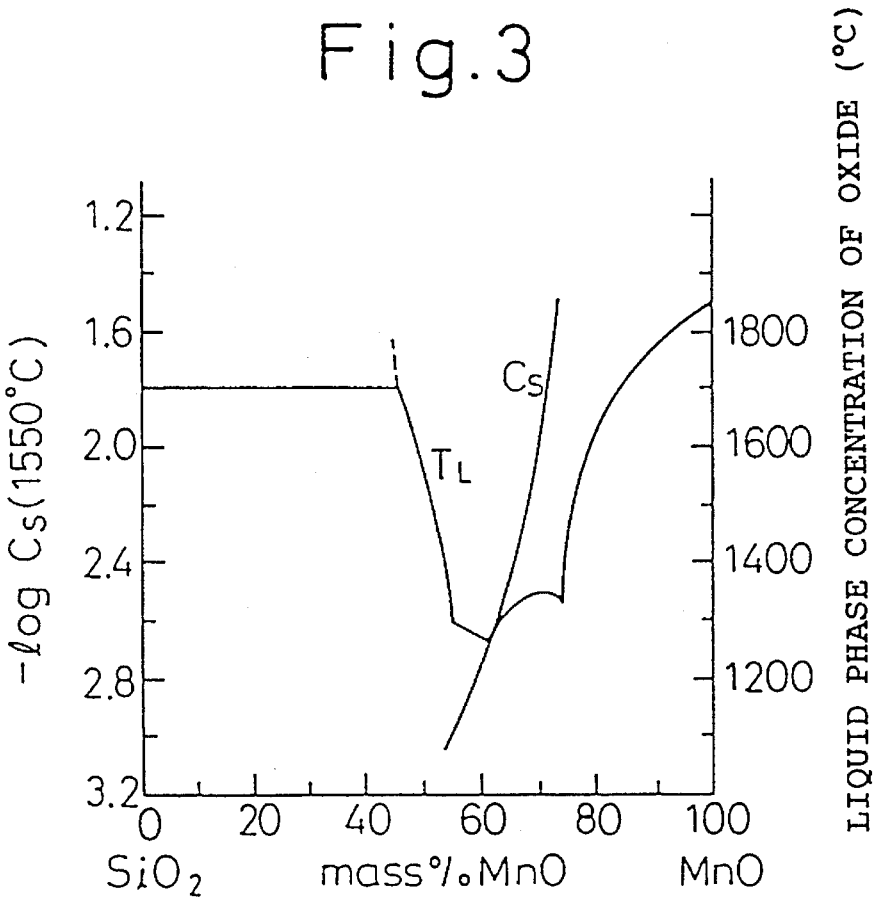
FIG. 3 is a diagram showing a change in melting point and a change in sulfide capacity (Cs) for an MnO—$SiO_2$ binary system.

On the other hand, in the present experiment, the constituent ratio of MnO to $SiO_2$, which has provided a high percentage precipitation, was, as shown in FIG. 3, in a region where the melting point of Mn silicate oxide was relatively low and the index Cs (sulfide capacity) indicative of the solubility of S was high. Therefore, the composition range of the oxide, obtained in the present experiment, suitable for the precipitation of MnS can be said to be based on the above mechanism.

The Mn silicate oxide falling within the composition range specified in the present invention, as shown in FIG. 1, can be prepared by regulating the Mn and Si contents of steel. Since Mn silicate oxide in steel is thermodynamically substantially in equilibrium with the Fin and Si contents of the steel, it is possible to determine the Mn and Si contents which provide a desired constituent ratio of MnO to $SiO_2$. A variation in Mn content causes a variation in necessary Si content. Therefore, the Mn and Si contents cannot be unconditionally determined but should be determined by several combinations of factors.

The Mn and Si contents specified in the present invention are necessary for forming Mn silicate having a desired composition. The upper limit of the Mn content is 30% from the viewpoint of avoiding an adverse effect on the quality of the steel. The upper limit of the Si content is 1.5% because Mn silicate cannot be formed if the Si content is excessively high. S, as described above, adversely affects the steel, and, therefore, the upper limit of the S content is 0.01%. The lower limits of the contents of individual elements were determined as those by which contemplated effects can be attained by the addition of respective elements.

Further, in the present invention, examples of various elements commonly incorporated in steel products include, but are not limited to, elements such as Cu, Ni, Cr, Mo, Nb, V, B, and Ca. These elements are optionally added according to properties required of the steel product.

In the steel, the oxygen concentration in equilibrium with the above desired constituent ratio of MnO and $SiO_2$ is about 70 ppm. For this reason, the oxygen concentration of the molten steel prior to the addition of Mn and Si is limited to not less than 70 ppm.

The molten steel having significantly improved percentage precipitation of MnS is applied to a twin-roll or belt type steel sheet production process involving rapid solidification wherein cooling is carried out at a rate of not less than 20° C./min in the whole slab region, enabling an oxide having a diameter (size) of 0.1 to 10 μm to be dispersed by 30 to 2000 pieces per $mm^2$ of sectional area of the slab.

That is, since the number and size of the oxides vary greatly depending upon the cooling rate of the slab the number and size of these oxides can be regulated as described by regulating the cooling rate. MnS precipitates utilizing the oxide as nucli in the course of cooling after complete solidification of the molten steel. Therefore, uniform distribution of fine MnS can be provided by regulating the composition of the oxide and the size and number of oxides in the above manner.

Even when MnS thus precipitated is once melted in a steel in the subsequent step of heat treatment or rolling, the oxide remains unchanged. Therefore, MnS again precipitates in the same manner utilizing the oxide as nucli. That is, MnS can be dispersed in steel independently of subsequent processes.

It is noted that, even though the steel contains oxides having the size of less than 0.1 μm or the size exceeding 10 μm, the effect of the present invention can be attained so far as the requirement for the number of oxides in the above size range is satisfied.

In general, in the steel production process, there is a high possibility that the composition of inclusions contains, besides the contemplated constituents, various other constituents due to oxides unavoidably included from raw materials, refractories, fluxes, and the like. Examples of such elements include Ca, Mg, Al, and Zr. Since, however, the amounts of oxides of these elements are generally very small, the MnS precipitation capability in the present invention is not influenced by such constituents.

When the casting process used is such that the cooling rate of slabs is not less than 5° C./min in the whole region of the slab (for example, in the case of the conventional continuous casting process, as shown in sample B of FIG. 1, which produces slabs having thickness of 30 to 400 mm), the oxides are likely to aggregate and coalesce into large clusters in the molten steel and the number of oxides is as small as 10 to 20 pieces/$mm^2$ in the center portion of the slab.

Based on the above facts, the present inventors have made studies on whether a method for refining oxides, disclosed in Japanese Unexamined Patent Publication (Kokai) No. 01-228643, i.e., a method wherein Zr, Ce, Hf, or Ti is added, can be applied to the present invention, and experiments were carried out for this purpose. As an example of the above molten steel composition, which can provide the Mn silicate composition having a high MnS precipitation capability, constituents were regulated so as to provide Mn=1% and Si=0.1%, and 0.02% of one of Zr, Ce, Hf, Ti, Y and Al was then added. Further, in the case of Zr and Ti, an experiment was also carried out wherein both Zr and Ti were added each in an amount of 0.01%. Further, in the case of Zr and Hf, an experiment was also carried out with the amounts of Zr and Hf added being varied.

Figure 4:
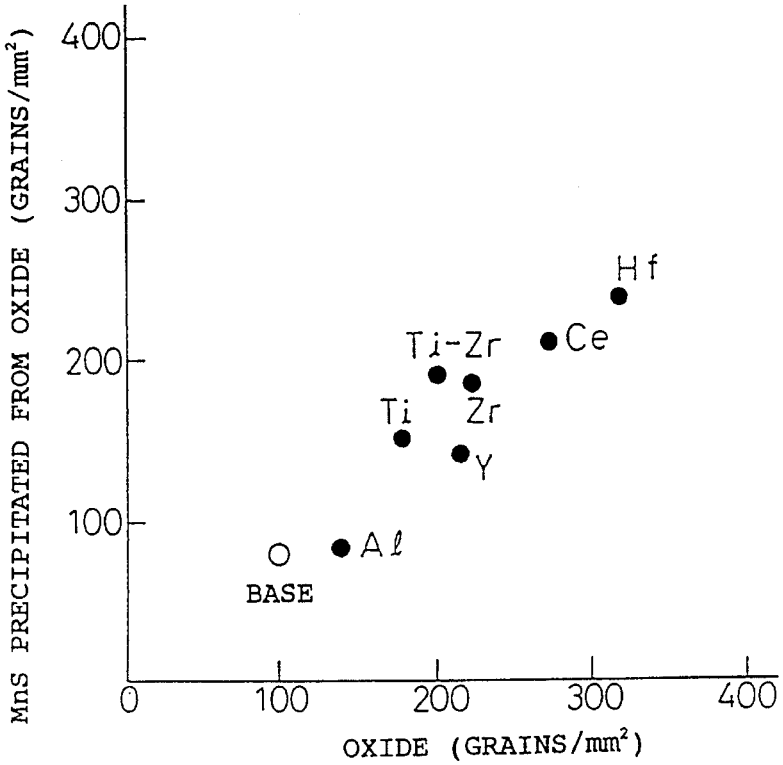
FIG. 4 is a diagram showing the relationship between the number of oxides and the number of MnS precipitated from oxides obtained in a laboratory.

FIG. 4 shows the relationship between the number of oxides and the number of MnS precipitated from the oxide in individual deoxidization processes. All the deoxidization processes provided an increase in both the number of oxides and the number of MnS, as compared with comparative materials prepared by a deoxidation process involving Mn and Si deoxidation alone. The order of the number of MnS was Hf>Ce>Zr>Ti>Y>Al>comparative material, and for the material containing both Ti and Zr, the number of MnS was larger than that for the materials containing one of Ti and Zr.

In FIG. 4, the ordinate represents the number of MnS. The number of each oxide was about 1.1 to 1.3 times the number of MnS obtained for all the deoxidizing elements, indicating that the MnS precipitation capability of the oxide was 80 to 90%, i.e., substantially equal to the MnS precipitation capability of Mn silicate alone obtained in a composition of Mn=1% and Si=0.1%.

This shows that the addition of strong deoxidizing elements to the steel of the present invention increases the number of oxides without detriment to the MnS precipitation capability inherent in Mn silicate in the composition of the steel.

Detailed analysis of the oxide thus obtained has revealed that the oxide is in the form of complex oxides of Mn silicate having high MnS precipitation capability and oxides of strong deoxidizing elements and MnS is preferentially precipitated in Mn silicate oxides. That is, the formation of complex oxides enables the functions of both the oxides to be utilized. Therefore, the formation of complex oxides of Mn silicate having particular MnO ratio and oxides of the strong deoxidizing elements results in the dispersion of a large number of fine MnS by virtue of synergistic effects.

It is considered that the addition of strong deoxidizing elements in an excessive amount reduces oxides, such as Mn silicate, thus reducing the amount of the oxides.

Figure 5:
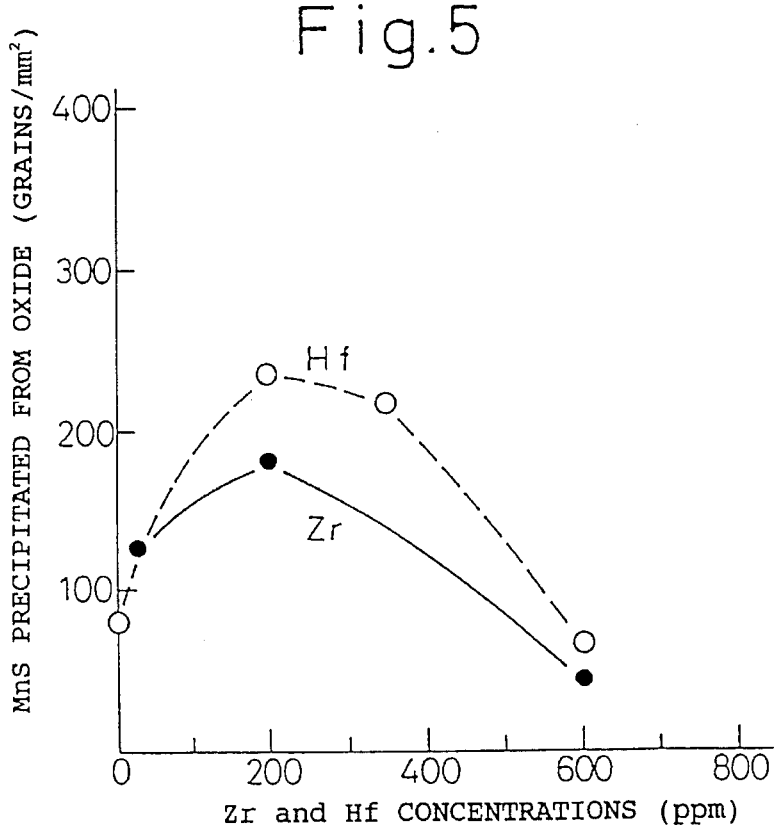
FIG. 5 is a diagram showing the relationship between Zr and Hf concentrations and the number of MnS precipitated from oxides.

In the addition of deoxidizing elements Zr and Hf to molten steel composition with the Mn and Si contents being regulated as described above, the amount of Zr and Hf added (ppm) was varied to determine the number of MnS precipitated from oxides of these elements. The relationship between the amount of these elements added and the number of MnS is shown in FIG. 5. From the drawing, it is apparent that the incorporation of a large amount of deoxidizing elements results in significant deterioration in effect and the content of the deoxidizing element is preferably not more than about 500 ppm. Although the lower limit of the deoxidizing element content is not particularly limited, an increase in number of MnS precipitated is observed when the content of the deoxidizing element is about 20 ppm.

The reason why the size and number of particles (oxide and MnS) are specified as described above is as follows.

Regarding their size, the oxides utilized in the present invention, unlike conventional large oxides, which are called "inclusions" of not less then several tens of μm in size and harmful to the quality of the steel, are very small. For example, the size of oxides and MnS, which are likely to serve as nucli for the transformation of a fine ferrite structure, is several μm, and the size of MnS, which is likely to serve as nucli for the precipitation of cementite is, in many cases, not more than 1 μm. Since, however, oxides having a size of less than 0.1 μm, necessitate the use of complicated means for the detection thereof, the size is limited to 0.1 to 10 μm. For oxides falling within this size range, the relationship between the number of oxides and the quality of the steel was investigated. For a cast slab for a large heat input welding plate and a cast slab for a deep drawing sheet produced, having fundamental compositions specified in Table 2, and by actual continuous casting, the relationship between the composition of oxides, the number of oxides having the above size, and property values of the product are provided in Tables 3 and 4.

TABLE 2

(wt %)

| Sample | C | Mn | P | S | Other constituents | Remarks |
|---|---|---|---|---|---|---|
| C | 0.1 | 1.5 | 0.005 | 0.005 | Added optionally | Cast slab for large heat input welding plate |
| D | 0.006 | 0.2 | 0.005 | 0.004 | Added optionally | Cast slab for deep drawing thin steel sheet |

Data on particles in the center portion of the thickness of cast slabs, which center portion is the part having the smallest number of oxides, for five samples of a cast slab for a large heat input welding plate (having a composition specified in sample No. C of Table 2) are provided in Table 3. From Table 3, it is apparent that, like sample No. 2, when the number of oxides is less than per $mm^2$ of sectional area of the cast slab, the requirement for the toughness at a low temperature (−60° C.) is not satisfied. Further, like sample No. 4, even when the number of oxides having a size of 0.1 to 10 μm is 170 pieces per $mm^2$ which satisfies the requirement for the number of oxides specified in the present invention, the requirement for toughness at −60° C. cannot be satisfied if the proportion of Mn oxide (MnO) is low. Further, like sample No. 1 or 5, even when an oxide of Ca or Al derived from refractories or flux-slag in the course of refining is included, no problem occurs so far as Mn oxide and Si oxide are present in respective predetermined proportions and the requirement for the size and number of oxides is satisfied. In the experiments conducted this time, no sample could be obtained wherein the number of oxides exceeded 2000. However, it is known that excessive increase in the number of oxides adversely affects the quality of the steel. For this reason, the upper limit of the number of oxides is 2000 pieces per $mm^2$ of sectional area of the cast slab.

For a sheet material produced by actual continuous casting (having a composition specified as sample No. D in Table 2), the relationship between the composition of oxides, the number of oxides having the above size, and the r value (an index indicative of deep drawability) of the product after continuous annealing were similarly investigated and are provided in Table 4. From Table 4, it is apparent that good r values could be obtained for sample Nos. 6 and 8 which satisfy the above requirements for the size and number of oxides.

For the reasons set out above, the size of oxides in the slab is limited to 0.1 to 10 μm, and the number of oxides in the slab is limited to 30 to 2000 per $mm^2$ of sectional area of the slab.

It is a matter of course that, even in the case of rapid casting at a cooling rate of not less than 20° C. in the whole slab region, for some materials, strong deoxidizing elements, such as Zr and Ti, may be added to provide the desired size and number of oxides.

TABLE 3

| Sample | Average composition of inclusions (wt %) | | | | | | | | Proportion of MnO | Size | Number of oxides | vTrs | Evaluation |
|---|---|---|---|---|---|---|---|---|---|---|---|---|---|
| No. | MnO | $SiO_2$ | $Al_2O_3$ | $ZrO_2$ | $Ti_2O_3$ | Mgo | CaO | MnS | *1 | *2 | *3 | *4 | |
| 1 | 56 | 21 | 5 | — | — | — | — | 28 | 72 | 5.8 | 52 | −65 | p |
| 2 | 43 | 18 | 16 | — | 9 | 2 | — | 12 | 70 | 9.1 | 21 | −48 | X |
| 3 | 31 | 17 | — | 13 | 23 | — | — | 16 | 65 | 3.6 | 230 | −71 | p |
| 4 | 12 | 67 | 11 | — | — | 8 | — | 2 | 15 | 4.1 | 170 | −51 | X |
| 5 | 26 | 18 | — | — | 42 | — | 3 | 11 | 60 | 4.9 | 96 | −67 | p |

*1: Proportion of Mn oxide to the sum of Mn oxide and Si oxide (wt %)
*2: Average size of oxides (μm)
*3: Number of oxides having a size of 0.1 μm to 10 μm per $mm^2$ of sectional area of slab (as measured around the center portion, having a small number of oxides, of the thickness of a continuous-cast slab)
*4: Ductile/brittle transition temperature after large heat input welding (quantity of heat input: 200 kJ/cm)

TABLE 4

| Sample | Average composition of inclusions (wt %) | | | | | | | | Proportion of MnO | Size | Number of oxides | r Value | Evaluation |
|---|---|---|---|---|---|---|---|---|---|---|---|---|---|
| No. | MnO | $SiO_2$ | $Al_2O_3$ | $Ce_2O_3$ | $Ti_2O_3$ | Mgo | CaO | MnS | *1 | *2 | *3 | *5 | |
| 6 | 24 | 19 | 5 | — | 32 | — | — | 20 | 56 | 2.8 | 74 | 2.1 | p |
| 7 | 18 | 25 | 32 | — | 7 | 2 | 9 | 7 | 42 | 4.3 | 38 | 1.6 | X |
| 8 | 27 | 17 | — | 17 | 26 | 1 | — | 12 | 61 | 2.1 | 237 | 2.2 | p |

*1: Proportion of Mn oxide to the sum of Mn oxide and Si oxide (wt %)
*2: Average size of oxides
*3: Number of oxides having a size of 0.1 μm to 10 μm per $mm^2$ of sectional area of slab (as measured around the center portion, having a small number of oxides, of the thickness of a continuous-cast slab)
*5: Index indicative of deep drawability as measured after continuous annealing (800° C × 60 sec) and overaging (400° C. × 300 sec)

EXAMPLES

Example 1

Steels comprising fundamental constituents specified as sample C in Table 2 were produced by actual converter, RH, and general continuous casting process, and samples were extracted from rolled steel plates and applied to welding tests.

In order to regulate oxides in the steels, Mn and Si were added at the time of tapping from the converter to form an Mn-silicate oxide. At that time, the Mn content was kept at a constant value of 1% with the Si content being varied, thereby varying the constituent ratio of MnO to $SiO_2$ in the Mn silicate.

In this case, the concentrations of Fin, Si, O, and the like were substituted in one of thermodynamic calculation models to determine the constituent ratio of MnO and $SiO_2$, based on which the range of the constituent ratio of MnO to $SiO_2$ varied was determined.

Further, strong deoxidizing elements for increasing the number of oxides were added in the step of RH in vacuum from the view point of regulating the very small amount of these elements added, and, immediately after the addition of the strong deoxidizing elements, casting was carried out in the step of continuous casting. In this case, the thickness of the continuous-cast material was varied because the cooling rate should be varied for the purpose of varying the size and number of oxides. This gave rise to a change in cooling rate in the center portion of the thickness of the cast slab.

Welding was carried out under large heat input conditions (200 kJ/cm), and the ductile/brittle fracture transition temperature was measured by a Charpy test. The results are given in Table 3. Samples Nos. 1, 3, and 5, satisfying the requirements specified in the present invention, could sufficiently satisfied the requirement for the property of the steel (in this example, −60° C.).

EXAMPLE 2

Steels comprising fundamental constituents specified as sample No. D in Table 2 were produced by actual converter, RH, and continuous casting process, cold-rolled into steel sheets which were then aged by continuous annealing process. Samples extracted from the resultant aged steel sheets were evaluated for deep drawability. The regulation of oxides in the steels was carried out in substantially the same manner as in Example 1. Specifically, at the outset, Fin and Si were added at the time of tapping from the converter to from an Mn-silicate oxide. At that time, the constituent ratio of MnO to $SiO_2$ in Mn silicate was varied by varying the Si content with the Mn content being kept a constant value of 0.2%. Further, strong deoxidizing elements for increasing the number of oxides were added in the step of RH in vacuum from the viewpoint of regulating the very small amount of these elements added, and, immediately after the addition of the strong deoxidizing elements, casting was carried out in the step of continuous casting.

The results are given in Table 4. Samples Nos. 6 and 8, satisfying the requirements specified in the present invention, could sufficiently satisfy the requirement for the property of the steel (in this example, r>2.0).

Industrial Applicability

As is apparent from the foregoing detailed description, the present invention can provide steel products with many fine particles of MnS being precipitated and dispersed in cast slabs and, hence, can provide steel plates having good toughness in a HAZ and steel sheets having excellent drawability, which renders the present invention very valuable from the industrial viewpoint.

We claim:

1. A continuous-cast slab having dispersed fine particles, characterized by comprising as main constituents Mn: 0.1 to 3.0% by weight, Si: 0.003 to 1.5% by weight, and S: 0.001 to 0.01% by weight, and including mnS and an oxide, both MnS and the oxide having a diameter of 0.1 to 10 μm, said oxide including Mn oxide and Si oxide with said Mn oxide occupying 50 to 80% of the sum of the Mn oxide and the Si oxide, said MnS and said oxide being dispersed in an amount of 30 to 2000 pieces per $mm^2$ of section of said cast slab.

2. The continuous-cast slab according to claim 1, which further comprises, besides said main constituents, 0.002 to 0.05% by weight in total of at least one element selected from Zr, Ti, Ce, Hf, Y, and Al.

3. The continuous-cast slab according to claim 1, produced by a thin steel production process involving rapid cooling.

4. A steel product, having dispersed fine particles, produced from a continuous-cast slab according to claim 1.

5. A steel product, having dispersed fine particles, produced from a continuous-cast slab according to claim 2.

* * * * *

UNITED STATES PATENT AND TRADEMARK OFFICE

CERTIFICATE OF CORRECTION

PATENT NO. : 5,534,084

DATED : July 9, 1996

INVENTOR(S) : Masamitsu WAKOH, et al.

It is certified that error appears in the above-indentified patent and that said Letters Patent is hereby corrected as shown below:

Column 1, line 50, change "AS" at beginning of line to --As--.

Column 1, line 61, change "Fins" to --MnS--.

Column 2, line 2, change "Fins" to --MnS--.

Column 2, line 37, after "40 to" insert --85%--.

Column 4, line 13, change "Fin" to --Mn--.

Column 4, line 33, change "Fin" to --Mn--.

Column 7, line 3, insert --30-- between "than" and "per"

Column 9, line 32, change "Fin" to --Mn--.

Column 9, line 64, change "Fin" to --Mn--.

Signed and Sealed this

Third Day of December, 1996

*Attest:*

Bruce Lehman

BRUCE LEHMAN

*Attesting Officer*

*Commissioner of Patents and Trademarks*